US011672306B2

(12) United States Patent
Lovell

(10) Patent No.: US 11,672,306 B2
(45) Date of Patent: Jun. 13, 2023

(54) UPPER FOR A SHOE

(71) Applicant: Boot Royalty Company, L.P., Fort Worth, TX (US)

(72) Inventor: Billy Wayne Lovell, Fort Worth, TX (US)

(73) Assignee: Boot Royalty Company, L.P., Fort Worth, TX (US)

( * ) Notice: Subject to any disclaimer, the term of this patent is extended or adjusted under 35 U.S.C. 154(b) by 0 days.

(21) Appl. No.: 16/178,724

(22) Filed: Nov. 2, 2018

(65) Prior Publication Data

US 2019/0133254 A1 May 9, 2019

Related U.S. Application Data

(60) Provisional application No. 62/582,159, filed on Nov. 6, 2017.

(51) Int. Cl.

| | |
|---|---|
| ***A43B 23/02*** | (2006.01) |
| ***A43B 5/00*** | (2022.01) |
| ***A43B 11/00*** | (2006.01) |
| ***A43B 3/02*** | (2006.01) |
| ***A43B 3/04*** | (2006.01) |
| ***A43B 21/24*** | (2006.01) |

(52) U.S. Cl.

CPC ..... *A43B 23/0295* (2013.01); *A43B 5/006* (2013.01); *A43B 3/02* (2013.01); *A43B 3/04* (2013.01); *A43B 11/00* (2013.01); *A43B 21/24* (2013.01); *A43B 23/027* (2013.01)

(58) Field of Classification Search

None

See application file for complete search history.

(56) References Cited

U.S. PATENT DOCUMENTS

| | | | | | |
|---|---|---|---|---|---|
| 2,446,158 | A * | 7/1948 | Miller | A43B 3/02 | 36/2 R |
| 3,514,877 | A * | 6/1970 | Coppola | A43B 1/0036 | 36/87 |
| 4,198,769 | A * | 4/1980 | Rigon | A43B 3/02 | 36/24.5 |
| 4,571,856 | A * | 2/1986 | Lin | A43B 5/00 | 36/114 |
| 4,693,021 | A * | 9/1987 | Mazzarolo | A43B 7/08 | 36/131 |
| D520,219 | S * | 5/2006 | Mazzarolo | D2/909 | |
| 9,210,959 | B1 * | 12/2015 | Jankowski | A43C 11/24 | |
| D782,787 | S * | 4/2017 | Jankowski | D2/901 | |
| D865,335 | S * | 11/2019 | Jankowski | D2/901 | |
| 2001/0001903 | A1 * | 5/2001 | Di Girolamo | A43B 7/125 | 36/3 R |

(Continued)

*Primary Examiner* — Jocelyn Bravo

(74) *Attorney, Agent, or Firm* — IP Attorneys Group, LLC; David Chen; Jared Vitola

(57) ABSTRACT

A shoe with a sole, upper, and shaft, whose upper and shaft contain a number of modifications to increase flexibility of the shoe but maintain protection for the wearer of the shoe. These modifications fall into the general categories of notch and aperture. The upper also has a number of protrusions into the shaft to increase protection in the protrusion areas. The location, shape, and size of these notches, apertures, and protrusions are important for optimizing the flexibility and protective qualities of the shoe.

20 Claims, 10 Drawing Sheets

(56) References Cited

U.S. PATENT DOCUMENTS

| | | | | |
|---|---|---|---|---|
| 2005/0076536 | A1* | 4/2005 | Hatfield | A43B 7/06 36/3 B |
| 2006/0191164 | A1* | 8/2006 | Dinndorf | A43B 7/18 36/50.1 |
| 2009/0158621 | A1* | 6/2009 | Yamamoto | A43B 23/07 36/98 |
| 2010/0031534 | A1* | 2/2010 | Davis | A43B 11/00 36/102 |
| 2011/0126431 | A1* | 6/2011 | Mazzarolo | A43B 5/145 36/3 A |
| 2012/0186106 | A1* | 7/2012 | Recchi | A43B 23/047 36/102 |
| 2012/0186110 | A1* | 7/2012 | Recchi | A43B 21/24 36/34 R |
| 2014/0007462 | A1* | 1/2014 | Engel-Currin | A43B 23/07 36/109 |
| 2014/0109442 | A1* | 4/2014 | Thompson | A43B 3/02 36/136 |
| 2014/0259783 | A1* | 9/2014 | Dinndorf | A43C 11/14 36/102 |
| 2014/0345165 | A1* | 11/2014 | Norwood | A43B 9/06 36/109 |
| 2014/0360051 | A1* | 12/2014 | Coulter | A43B 23/0295 36/87 |
| 2018/0042337 | A1* | 2/2018 | Davis | A43B 7/32 |

* cited by examiner

UPPER FOR A SHOE

CROSS REFERENCE TO RELATED APPLICATIONS

This application is a non-provisional application which claims priority to and the benefit of U.S. Provisional Patent Application No. 62/582,159, filed Nov. 6, 2017 and titled 'Shaft for a Boot'. The contents of the above-identified application are relied upon and incorporated herein by reference in their entirety.

FIELD OF THE INVENTION

The present invention regards shoes, specifically shoes with features added to enhance the flexibility of the shoes.

BACKGROUND OF THE INVENTION

Typically, shoes that have parts which extend over the ankle, especially if these parts rise close to the knee, constrict movement of the calf, knee, or ankle regions. An example of this is the typical western style boot which has a shaft that extends up from the heel typically ten to fifteen inches, often encasing and restricting movement of the ankle and most of the calf region. And while this shaft can be useful for protection while working in different conditions for the wearers of such boots, or for ornamentation for special events like dances, in these environments where there is significant movement in the foot and calf region, shaft flexibility also can be necessary.

In attempts to increase flexibility and ease of getting such shoes on and off, the prior art often adds elements such as zippers, laces, or clips. However, such elements can reduce the structural integrity and unified structure of the shaft, thus reducing its protective properties and structural features. Alternatively, the prior art has designed shoes with removable shafts, but this opens up the possibility that the shaft could fall off if not properly adhered to the shoe, as well as the possibility of losing the shaft when disassembled.

In light of these issues, what is needed is a shoe that has a fixed shaft with elements that increase flexibility in the shaft but also maintain the protection, structural features, and other functionalities of similar shoes.

SUMMARY OF THE INVENTION

The object of the present invention is to provide a shoe with a fixed shaft with added flexibility yet limited reduction to the protective nature of the shaft. Thus, the present invention comprises a shoe with a sole, upper, and a shaft. The upper and shaft include one or more structural modifications which increase flexibility. These modifications generally fall into the broad category of notch or aperture.

The location, shape, and size of these notches and apertures are important for optimizing the flexibility and protective qualities of the shoe. In some embodiments the notch and aperture are generally parallel to one another, and in other embodiments they are generally perpendicular to each other. In some embodiments the notch and aperture are both in the same area of the shaft, such as the top, and in other embodiments they are in different areas of the shaft.

In some embodiments, protrusions of the upper onto the bottom of the shaft are provided to give added protection. In some embodiments these protrusions are generally parallel to one another and in other embodiments these protrusions are generally perpendicular to one another. In some embodiments the shaft also has protrusions on the top as a means of aiding in putting on the shoe.

In some embodiments the shaft is a single section held together by a single seam and in other embodiments the shaft is multiple sections held together by multiple seams. This multiplicity of shaft sections allows for different material types to make up different areas of the shaft, in order to enhance the protection or flexibility of a specific task.

The particular details and benefits of the present invention will be apparent to those of skill in the art based on the following description with reference to the appended drawings.

DETAILED DESCRIPTION OF THE DRAWINGS

Referring now to the figures, where identical elements are numbered identically throughout, a description of exemplary embodiments of the present invention will be provided. The lines consisting of a repeating dot/dash pattern (such as line 64 in FIG. 3) are intended to denote an area and are not part of the embodiment itself.

Figure 1:
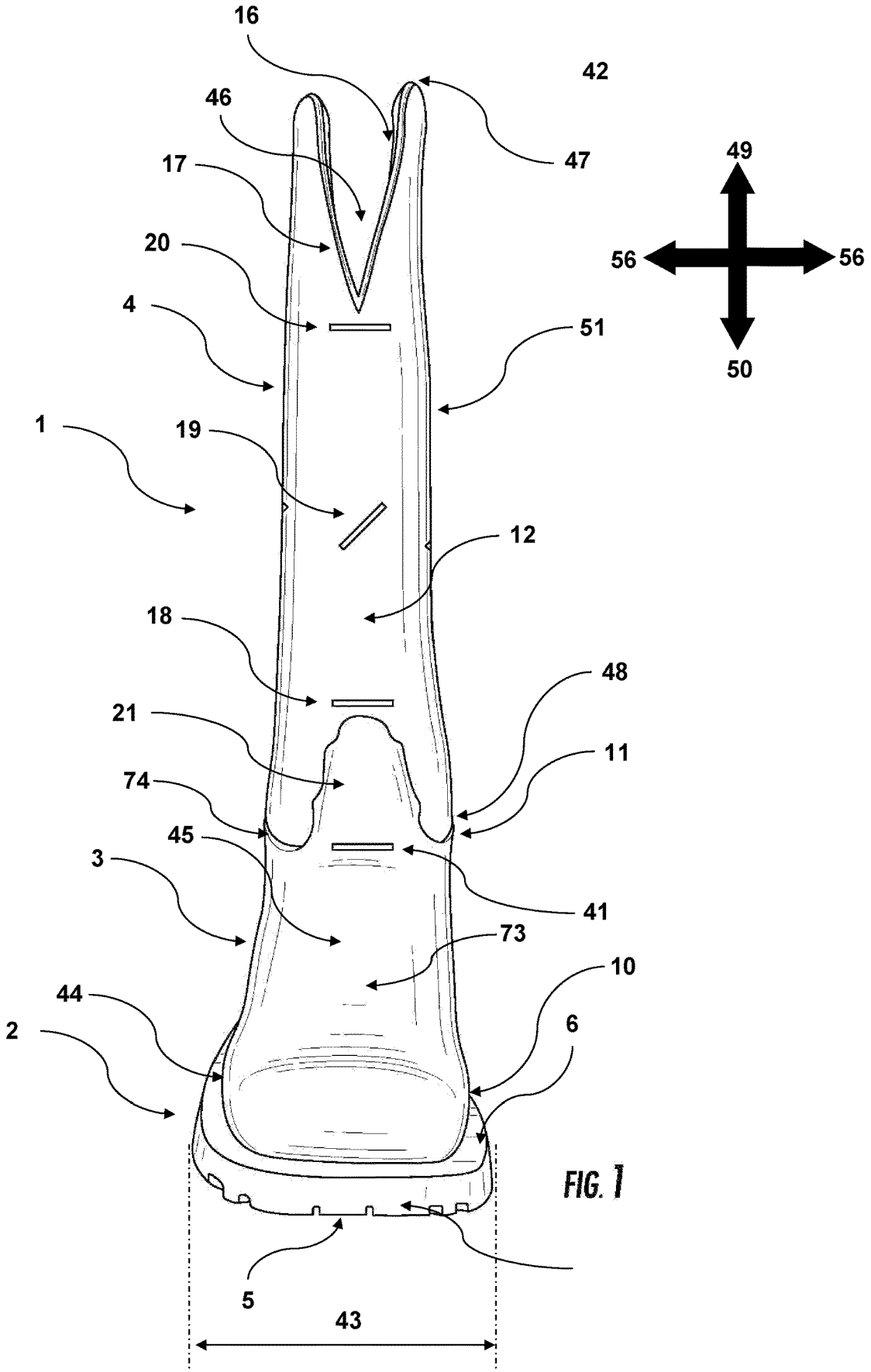
FIG. 1 is a front view of a shoe containing a sole, an upper, and a shaft, with the upper showing at least one of a number of possible protrusions into the shaft, and the shaft showing a number of possible notches and apertures.
Figure 2:
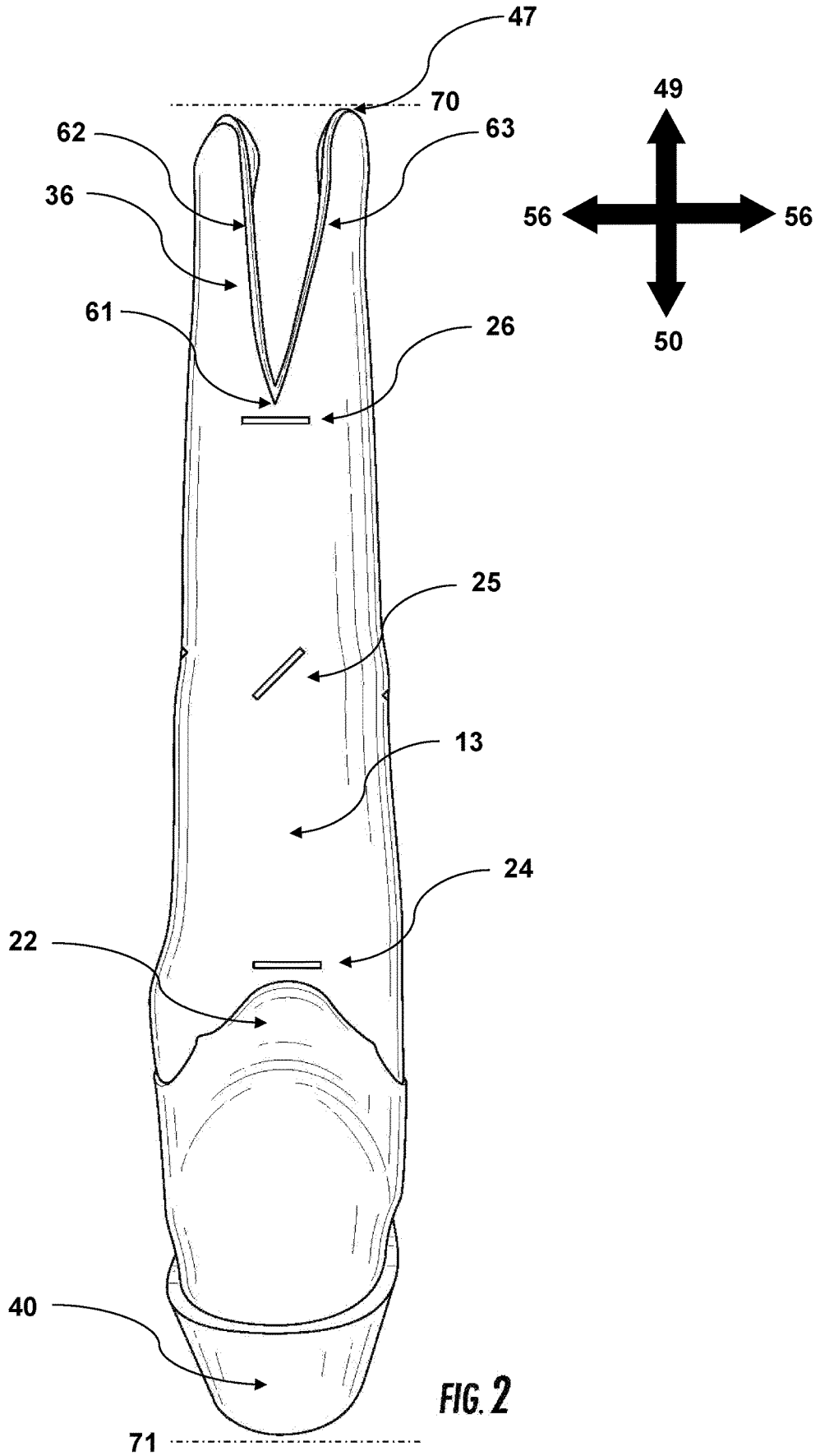
FIG. 2 is a back view of the shoe shown in FIG. 1, which contains a sole, an upper, and a shaft, with the upper showing at least one of a number of possible protrusions into the shaft, and the shaft showing a number of possible notches and apertures.
Figure 3:
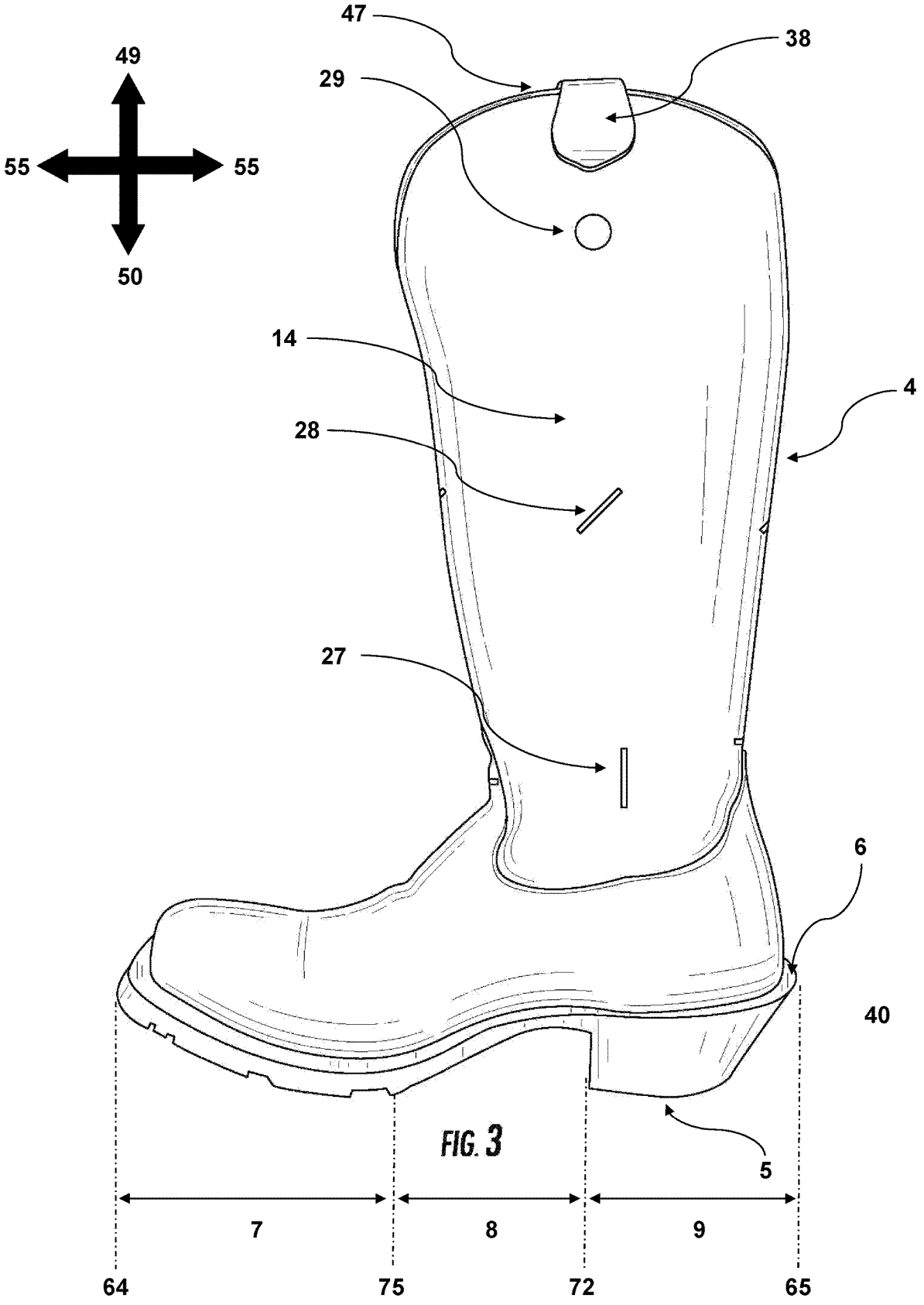
FIG. 3 is an intrados view of the shoe shown in FIG. 1, which contains a sole, an upper, and a shaft, showing the shaft with a number of possible apertures.
Figure 4:
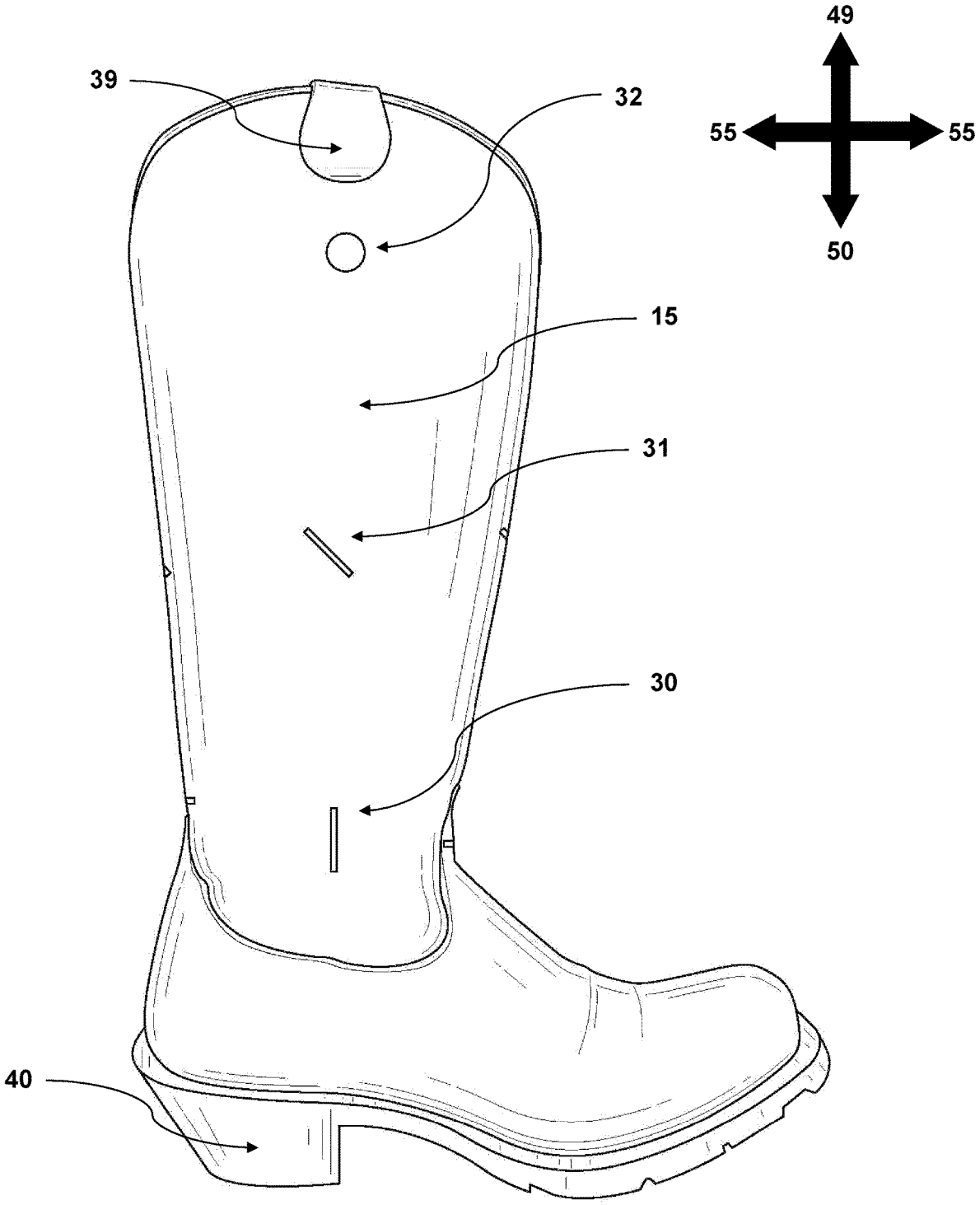
FIG. 4 is an extrados view of the shoe shown in FIG. 1, which contains a sole, an upper, and a shaft, showing the shaft with a number of possible apertures.

FIG. 1 shows the front view of shoe 1, containing sole 2, upper 3, and shaft 4. Shoe 1 has a front, denoted by dotted line 64 (FIG. 3), a back, denoted by dotted line 65 (FIG. 3), a top, denoted by dotted line 70 (FIG. 2), and a bottom, denoted by dotted line 71 (FIG. 2). FIGS. 2, 3, and 4 show different perspectives of the same shoe embodiment. FIGS. 5-8 show different embodiments of the invention, which will be discussed in more detail below.

Seen in FIG. 1, sole 2 contains bottom 5 which faces downwards (50) when wearing the shoe, and top 6 which faces upwards (49) when wearing the shoe. FIG. 3 shows the general toe, arch, and heel regions which are designated by 7, 8, and 9, respectively. Toe region 7 is located in the front (64) of the shoe and heel region 9 is located at the back (65) of the shoe. In some embodiments the thickness of sole 2 (the distance between top 6 and bottom 5) changes between front 64 and back 65. In some embodiments the thickness of sole 2 varies within a given region. In other embodiments, the thickness of sole 2 is generally consistent. The sole has an outside perimeter (42). In some embodiments, the width (43) of outside perimeter 42 varies between the toe (7), arch (8) and heel (9) regions. In other embodiments, width 43 of perimeter 42 varies within a single region. In other embodiments, width 43 of perimeter 42 is generally consistent. Sole 2 is made of rubber (natural or synthetic), polyurethane, ethylene vinyl acetate, or polyvinyl chloride, or any combination of these materials.

Upper 3 contains bottom 10, which faces downwards (50) when wearing the shoe and is connected to the upper surface of the sole (6), and top 11, which faces upwards (49) when wearing the shoe. Upper 3 has a toe, arch, and heel region, generally designated by 7, 8, and 9, respectively (FIG. 3). Bottom 10 of upper 3 has an outside perimeter (44). In some embodiments perimeter 44 is generally the same size as perimeter 42. In other embodiments perimeter 44 is larger than perimeter 42, and in yet other embodiments perimeter 44 is smaller than perimeter 42. Upper 3 has an outside (45) which is opposite to the inside (46) where the foot would be placed. Upper 3 is made of leather (natural or synthetic), mesh, rubber (natural or synthetic), neoprene, nylon, nitrile, foam, or any combination of these materials.

FIGS. 1-4 each show the different faces of shoe 1 and shaft 4. For shaft 4 in particular, FIG. 1 shows front 12, FIG. 2 shows back 13, FIG. 3 shows intrados 14, which faces the other shoe when wearing the shoes, and FIG. 4 shows extrados 15, which faces away from the other shoe when wearing the shoes. Shaft 4 has a top (47) which faces upwards (49) when wearing the shoe, and a bottom (48) which faces downwards (50) when wearing the shoe. Bottom 48 is connected to the top of the upper (11). In some embodiments shaft 4 is connected to the outside of the upper (45) and in other embodiments shaft 4 is connected to the inside of the upper (46). The shaft has an inside (16) which is where the leg is placed, and an outside (51) which is opposite to inside 16. Shaft 4 is made of leather (natural or synthetic), mesh, rubber (natural or synthetic), neoprene, nylon, nitrile, foam, or any combination of these materials.

Figure 7:
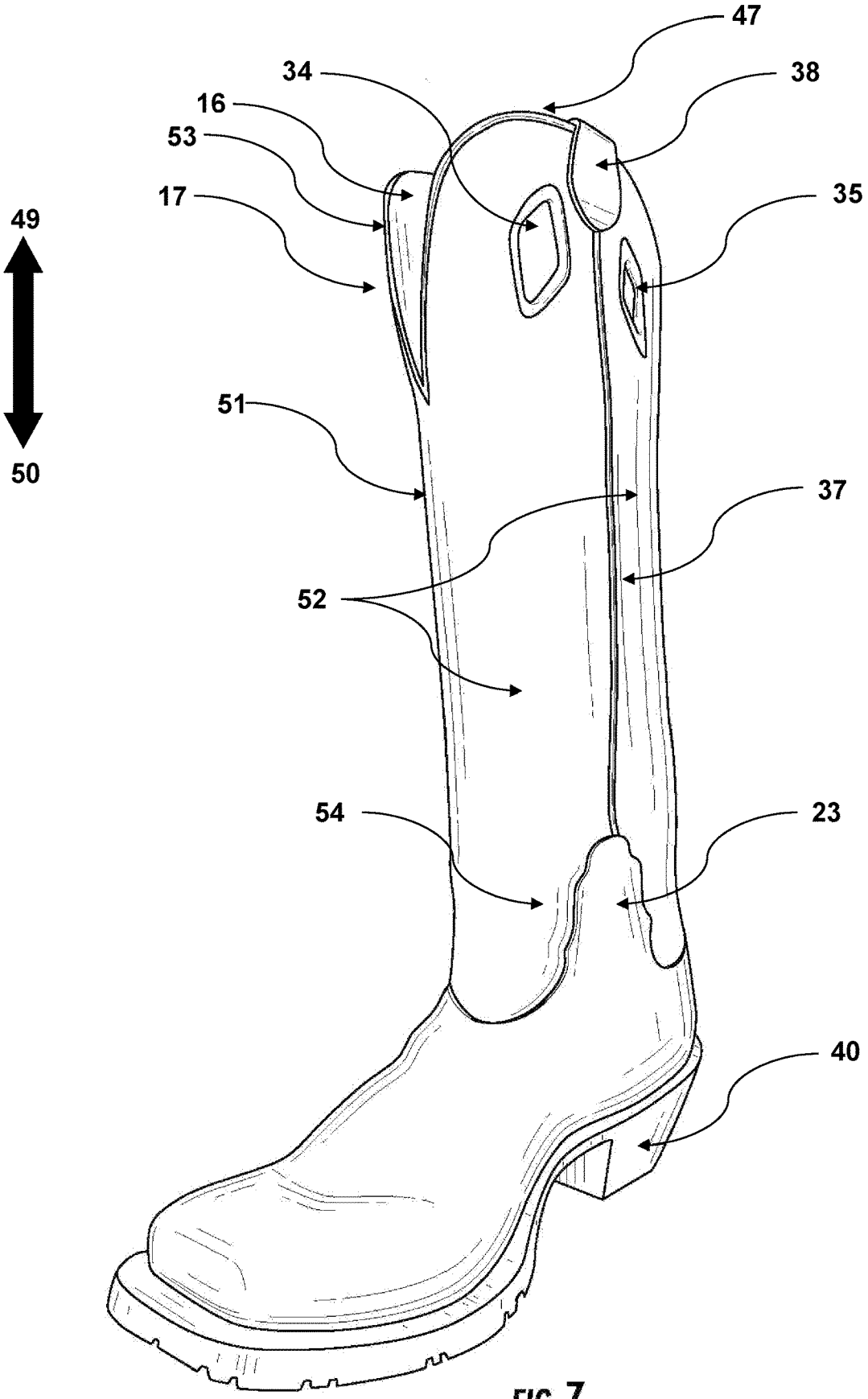
FIG. 7 is an angled view of a shoe containing a sole, an upper, and a shaft, with the upper showing at least one of a number of possible protrusions into the shaft, and the shaft showing a number of possible notches and apertures.
Figure 8:
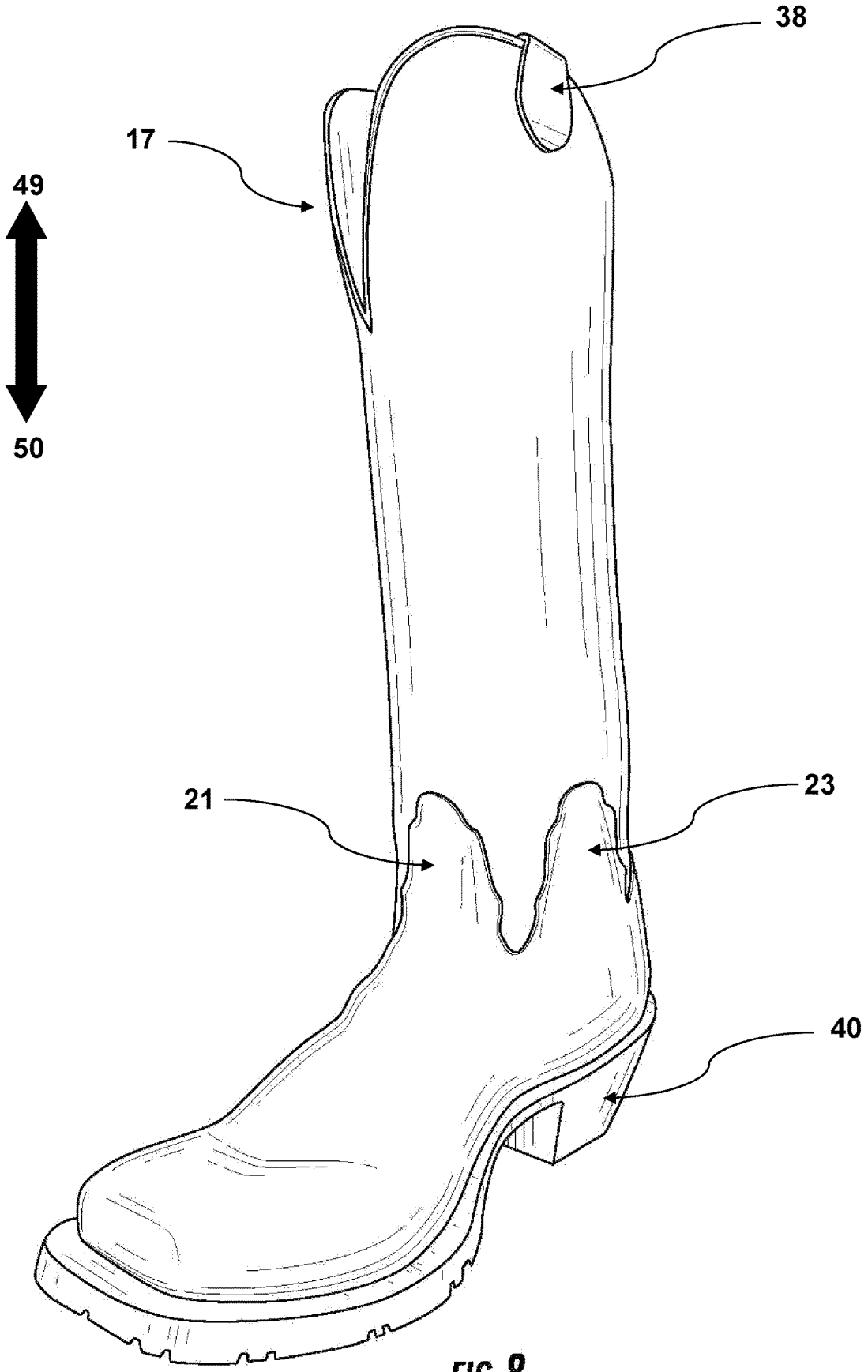
FIG. 8 is an angled view of a shoe containing a sole, an upper, and a shaft, with the upper showing at least one of a number of possible protrusions into the shaft, and the shaft showing a number of possible notches and apertures.

FIGS. 1 and 2 show two protrusions of the upper (21 and 22) into shaft 4 which in the example embodiment shown are located in the front of the shaft (protrusion 21) and the back of the shaft (protrusion 22). FIGS. 7 and 8 show another embodiments, with protrusion 23 located on the intrados of the shaft. The number and combination of these protrusions are varied depending on the required protection and flexibility. As in some embodiments the protrusions give at least one extra layer of material, the areas covered by said protrusions will have increased protection but more limited movement, thus different embodiments are required depending on the specifics of the protection and movement needed for different activities. In other embodiments the material difference between the upper and shaft is what gives the added protection in the shaft area where the protrusion is located. In one embodiment of the invention, there are two protrusions (21 and 22) from upper 3 into the front (12) and back (13) of shaft 4. This embodiment is useful for when protection is needed mainly in the sagittal plane (55) such as protection from debris generated when using a circular saw. In other embodiments, the two protrusions are into the intrados (14) and extrados (15) of shaft 4. This embodiment is useful for when protection is needed mainly in the lateral plane (56). In other embodiments, the two protrusions (21 and 23, FIG. 8) are generally perpendicular to one another, such as into the front (12) and intrados (14) of shaft 4. This embodiment is useful for when protection is needed on two perpendicular sides, yet significant flexibility is still needed in the other sides, such as when riding a horse. While riding a horse, protection on the front (12) and extrados (15) from trees or other objects are required in combination with flexibility in the back (13) and intrados (14) for interaction with the animal. In yet other embodiments there are three or more protrusions into the shaft, for example protrusions 21, 22, and 23 (FIGS. 1, 2, and 8). This embodiment is useful when maximum protection but the least flexibility is required. In some embodiments the protrusions are located on the outside of the shaft (51), and on other embodiments the protrusions are located on the inside of the shaft (16).

Figure 6:
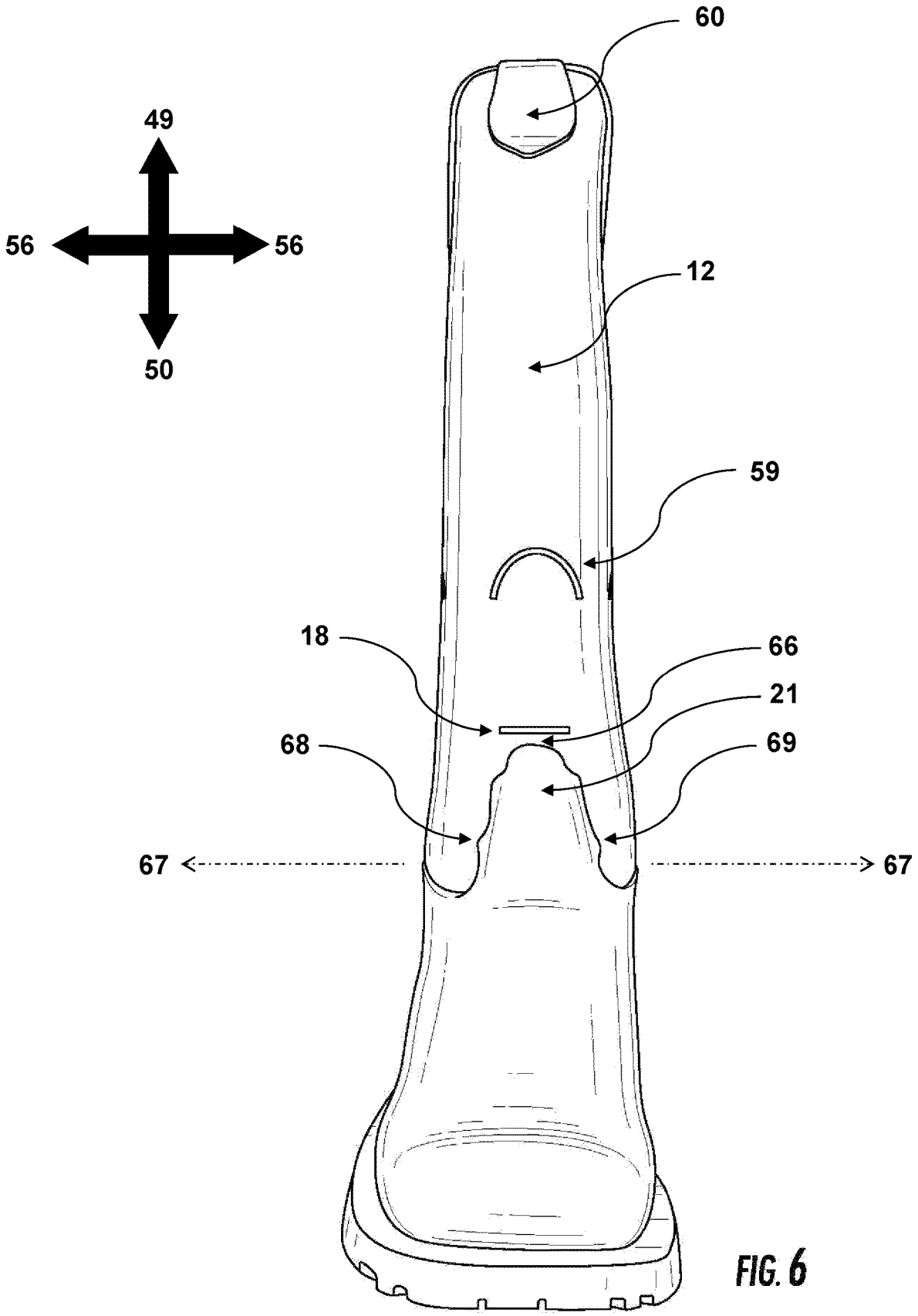
FIG. 6 is a front view of a shoe containing a sole, an upper, and a shaft, with the upper showing at least one of a number of possible protrusions into the shaft, and the shaft showing a number of possible notches and apertures.
Figure 9:
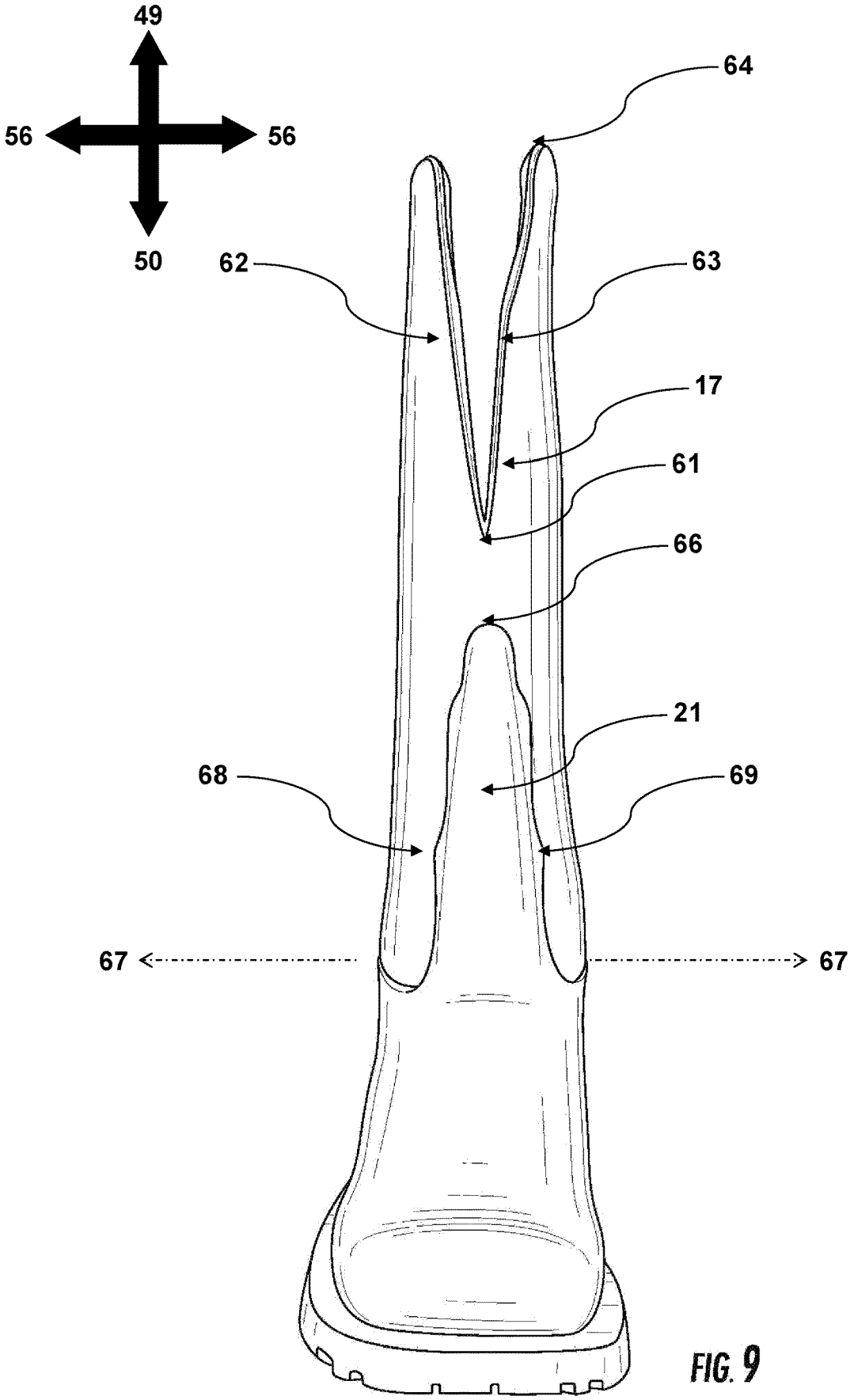
FIG. 9 is a front view of a shoe containing a sole, an upper, and a shaft, showing a shaft with a longer notch and upper with a longer protrusion than the shoe shown in FIG. 1.

The size of the protrusions also varies depending on the embodiment. FIG. 6 shows protrusion 21 on the front of the shaft (12). In this embodiment, protrusion 21 only covers a small portion of the entire front part of the shaft (12). However, the location, width, and length of these protrusions are useful for modifying the flexibility and protection of the shoe. FIG. 9 shows a different embodiment of protrusion 21, where 21 is significantly larger than the embodiment shown in FIG. 6. The height of a protrusion is measured from the topmost point 66 to line 67 which is drawn around where the anklebone would be when wearing the shoe. The width of a protrusion is measured from the farthest point on the left (68) to the farthest point on the right (69) side. In some embodiments, the height of protrusion 21, or other similar protrusions (22, 23, etc.) is less than one inch, in other embodiments the height of protrusion 21, or other similar protrusions (22, 23, etc.) is one to three inches and in other embodiments the height of protrusion 21, or other similar protrusions (22, 23, etc.) is three to five inches. Likewise, in some embodiments the width of protrusion 21, or other similar protrusions (22, 23, etc.) is less than one inch, in other embodiments the width of protrusion 21, or other similar protrusions (22, 23, etc.) is one to three inches, and in other embodiments the width of protrusion 21, or other similar protrusions (22, 23, etc.) is three to five inches. The embodiments where the protrusions have a length or width less than one inch are useful when only a minimal amount of protection but a maximal amount of flexibility is required. In contrast, the embodiments where the protrusions have a length or width three to five inches are useful when maximum protection but minimal flexibility is required. In-between these two extremes are the embodiments where the protrusions have a length or width one to three inches in the horizontal or vertical directions, which gives a balance of flexibility and protection.

FIGS. 1-9 show five potential embodiments in regards to the aperture and notch location, shape, and size. While a notch is generally a "V" shaped cut or modification to the material, apertures can take a variety of forms. In some embodiments, the aperture(s) are horizontal slices (18, 20, 24, 26, 57), in others diagonal slices (19, 25, 28, 31), in others arch-shaped slices (58), or in others vertical slices (27, 30), as seen in FIGS. 1-6. In other embodiments the aperture(s) are holes (29, 32, 34, 35) as seen in FIGS. 3, 4, and 7, in other embodiments gaps, or in other embodiments other such openings or spaces. In other embodiments the apertures are combinations of the above listed forms. In addition to ventilation, the varying shapes listed above are specifically designed for different purposes. When looking directly at the aperture, horizontal slices are designed for optimizing flexibility in the forward and backward direction, diagonal slices are designed for optimizing flexibility while twisting, vertical slices are designed for optimizing flexibility in the left and right direction, and arch-shaped slices are designed to aid in the contour of the ankle, knee, or other rounded objects. Similarly, holes are used around the circular ankle bone to better fit around the joint. Circular, diamond, or rectangular holes are also useful as a means to insert fingers to aid in the process of putting on the shoe.

In some embodiments, such as the one shown in FIGS. 1 and 2, notches 17 and 36 are placed in the front (12) and back (13) of shaft 4, respectively. In other embodiments, such as the one shown in FIG. 5, one or more notches 33 are placed on the intrados (14) or extrados (15) of shaft 4. FIGS. 1-4 show a number of different aperture shapes and locations. In some embodiments, aperture(s) are located near the bottom of the shaft (48), close to the ankle area (54, FIG. 7) on either the front (12), back (13), intrados (14), or extrados (15) of shaft 4. These apertures are labeled as 18, 24, 27, and 30, respectively. Similarly, in other embodiments, aperture(s) are located near the middle of shaft 4 (19, 25, 28, and 31) or in other embodiments near the top (47) of shaft 4 (20, 26, 29, 32). The location of the notches and apertures is important for improved flexibility and ease of putting on and taking off the shoe. For instance, at least one aperture near the bottom of the shaft (48), or around ankle area 54, would give the ankle and lower calf increased flexibility. Apertures near the top of the shaft (47) are used as anchor points to put fingers into as a means of pulling up the shoe shaft. Apertures near the middle of the shaft are used for ventilation and for an increase in the twisting motion of the shaft.

Figure 5:
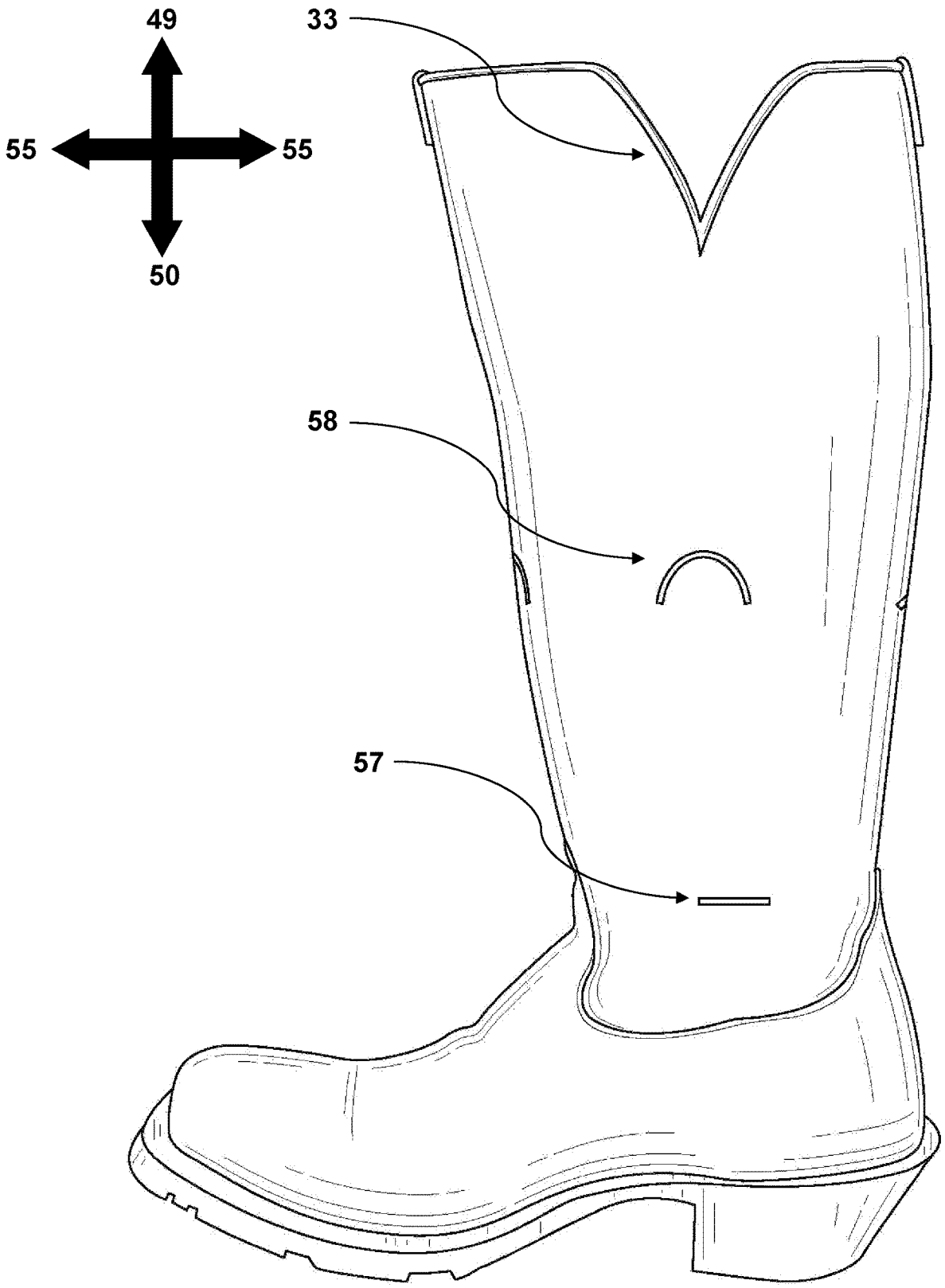
FIG. 5 is an intrados view of a shoe containing a sole, an upper, and a shaft, showing the shaft with an alternative number of possible notches and apertures as the shoe shown in FIG. 1.
Figure 10:
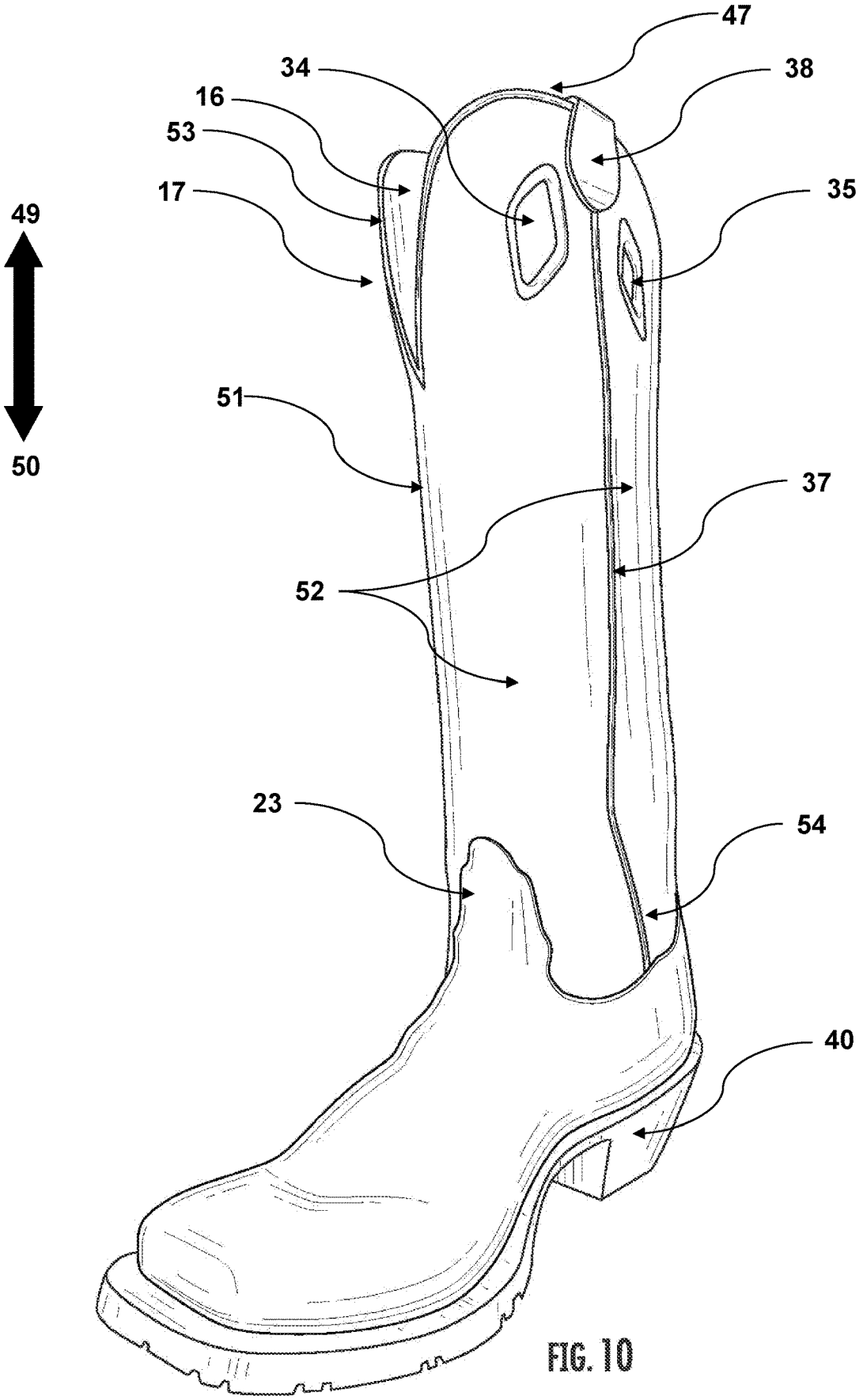
FIG. 10 is an angled view of a shoe containing a sole, an upper, and a shaft, with the upper showing at least one of a number of possible protrusions into the shaft, and the shaft showing a number of possible notches and apertures.

While multiple apertures and notches are shown in the figures, only one notch and one aperture is required for any given embodiment. Thus, there are several possibilities in terms of the combination of notch and aperture placement. In one embodiment, a single notch and aperture are generally parallel to one another, such as notch 17 combined with aperture 18 in FIG. 1. In another embodiment, a single notch and aperture are generally perpendicular to one another, such as notch 17 combined with aperture 27, shown in FIGS. 1 and 3, respectively. In another embodiment there are two notches generally parallel to one another with an aperture generally perpendicular to one of them, such as notches 17 and 36 in combination with aperture 27 (FIGS. 1-3). In another embodiment there are two notches generally perpendicular to one another with an aperture generally parallel to one and generally perpendicular to another, such as notches 17 and 33 in combination with aperture 57 (FIGS. 1 and 5). In another embodiment there are two apertures and a notch all generally parallel to one another, such as apertures 18 and 20 in combination with notch 17 seen in FIG. 1. In another embodiment the two apertures are generally parallel with the notch perpendicular. Other embodiments include other such combinations. In another embodiment two apertures are next to one another in the same area, as shown with apertures 34 and 35 which are both located near the top (47) of shaft 4 (FIGS. 7 and 10). In another embodiment a single aperture spans over more than one location, for example aperture 19 (FIG. 1) combined with aperture 28 (FIG. 3) to make one larger aperture which covers both the front (12) and intrados (14) sides of shaft 4. What is listed above in not intended to be an exhaustive list of the potential combinations, but simply a general overview of the different possible locations, relative placement, and possible number of notches and apertures located on a single shaft 4.

The size and length of the notch is also varied depending on the embodiment. Each notch has a peak point (61) and two edges (62 and 63). FIG. 2 shows notch 36 whose peak point 61 is located about a quarter of way down from shaft top 47. This distance between peak point 61 and shaft top 47 denotes the length of notch 16. There is also a specified distance between edges 62 and 63, measured from the top (47) of shaft 4, which denotes the notch width. In some embodiments, notch 36, or other similar notches (17, 33, etc.) are cut deeper or shallower into the shaft, an example of which shown in FIG. 9. In some embodiments these notches are wider or narrower then depicted. In some embodiments said notches are less than one inch in length, in other embodiments, said notches are one to three inches in length, in other embodiments said notches are three to five inches in length, and in other embodiments said notches are five to seven inches in length. In some embodiments said notches are less than one inch wide. In other embodiments, said notches are one to three inches wide, and in other embodiments, said notches are three to five inches wide. In some embodiments with two or more notches, the notches are all generally the same length and width as each other. In other embodiments with two or more notches, the notches are different lengths and widths. These different length and width notches allow for movement at the top of the shaft (47) and would be useful when putting the shoe on or taking it off and when completing activities where the foot has significant movement in an up and down or rotating motion, as the calf muscle would have room to flex and relax in the various directions. In addition, as each individual has different calf sizes, the different notch lengths are useful for tailoring to those differences, especially for shoes with longer shafts which encase more of the calf. The embodiments where the notch length or width is less than one inch is useful for when maximum protection but limited movement and ease of putting on is desired. In contrast, the embodiments where the notch length is five to seven inches are useful when less protection but significant flexibility and ease of putting on is desired. In-between these two extremes are the two embodiments ranging from one to three and three to five inches, which are both used when balancing flexibility and protection.

FIG. 1 shows an embodiment with aperture 41 on upper 3. In some embodiments, aperture 41 is in combination with other apertures and notches and in other embodiments aperture 41 is absent. Aperture 41 is used for ventilation, cooling the foot encased in upper 3. As an aperture in upper 3 reduces protection, the placement of the aperture, one that maximizes cooling but minimizes protection loss is essential and will vary depending on where maximum protection is necessary. In some embodiments aperture 41 is shifted onto protrusion 21, and in other embodiments, it is shifted down towards the tow region (9) of upper 3.

FIGS. 3 and 4 show an embodiment with additional protrusions 38 and 39 on the top of the intrados (14) and extrados (15) faces of shaft 4, respectively. Protrusions 38 and 39 are used for added grip when pulling on the shoe, and thus are made of a material with traction such as leather. In other embodiments, these protrusions are shifted to the front (12) and back (13) of shaft 4, such as protrusion 60 in FIG.

6, depending on the location of the notch(es) (17, 33, 37, etc.). In other embodiments only one of these protrusions are present, and in other embodiments these protrusions are absent altogether. The length and width of the protrusions can also be modified, as with the lower protrusions (21, 22, 23, etc.) discussed above.

FIGS. 7 and 10 show an embodiment with seam 37 located on the intrados (14) face of shaft 4. This seam holds together the two sections (52) of shaft 4, mostly comprising the front (12) and back (13) face. In one embodiment, there is another seam which is generally opposite to seam 37, being about the same distance if measured one direction around shaft 4, for example clockwise, as if measured the other direction around shaft 4, for example counterclockwise. In another embodiment, these generally opposite seams are located on the front (12) and back (13) of shaft 4, with the two sections (52) generally comprising the intrados (14) and extrados (15) face. In another embodiment, shaft 4 is made of a single section 52 with only one seam required, which is located anywhere around shaft 4. In another embodiment, more than two sections 52 make up shaft 4 requiring three, four, or even more seams. For embodiments with two seams, the seams are not required to be generally opposite one another. In some embodiments with two sections 52, one section 52 is significantly smaller than the other section 52, with the two seams 37 being significantly closer to one another in one direction around shaft 4, and significantly farther apart in the other direction around shaft 4. In some embodiments with more than two seams, the seams are generally evenly spaced around shaft 4. In other embodiments with more than two seams, the seams are not evenly spaced around shaft 4. In some embodiments with more than two shaft 4 sections 52, each section 52 is generally the same size, and in other embodiments the sections 52 have different sizes. In some embodiments there are sections 52 which are combined horizontally, creating both vertical and horizontal seams. These different numbers of sections and seams are useful for modifying the properties and durability of shaft 4. A single section 52 and seam leads to the least number of seams which can come apart thus giving the greatest durability. However, multiple sections 52 and different sized sections allow for different materials to be used in different areas of shaft 4, discussed in more detail below.

Each of the sections 52 that make up shaft 4, as seen in FIGS. 7 and 10, has a general outside 51 and a corresponding inside 16. In some embodiments these sections 52 are made of single layer 53. In other embodiments shaft sections 52 are made of two layers 53 connected in some way, one being on outside 51 and another being on inside 16. In some embodiments shaft 4 sections 52 are made of more than two layers 53, one being on outside 51 and another being on inside 16 with middle layer(s) 53 in-between the two. In some embodiments containing two or more shaft 4 layers 53, layers 53 are the same material. In other embodiments containing two or more shaft 4 layers 53, layers 53 are different material. In some embodiments, the various shaft sections 52 are all made of the same materials and have generally the same layer 53 composition. In other embodiments, the various shaft 4 sections 52 are made of different materials and have different layer 53 compositions.

In many cases a single shaft 4 composition is adequate, however in many cases having shaft 4 with different sectional 52 compositions are beneficial. For example, in one embodiment a small section 52 is placed over the ankle area (54) which has different properties than the other shaft 4 sections 52, such as being more flexible or more protective. This embodiment is useful for situations such as riding a horse, where it is beneficial to have different material(s) facing inwards to the horse, ones that are more flexible and breathe more, than on the outside of the horse, ones that are more durable and protective. Embodiments where the layers 53 are different material can be useful for waterproofing the shoe, such that a rubber or other waterproof material can be put on the outside, but a cooler material or one less prone to stick to the skin can be put on the inside. Alternatively, often softer or more comfortable materials are desired on the inside of a shoe for contact with the skin but significantly rougher and more durable materials are desired for the outside of the shoe which is exposed to different hazardous conditions. Insulating internal layers are also useful for preventing skin contact with extreme cold or heat.

In one embodiment, as seen in FIG. 1, upper 3 is a single section 73 of leather or other similar materials. However, in other embodiments multiple upper sections 73 are used which are held together by one or more seams. Additionally, as with the shaft, in some embodiments the upper section(s) 73 are made of a single layer 74, and in other embodiments the upper section(s) 73 are made of two layers 74, one being on outside 45 and another being on inside 46. In yet other embodiments, the upper section(s) 73 are made of more than two layers 74, one being on outside 45 and another being on inside 46 with middle layer(s) 74 in-between the two. In some embodiments containing two or more layers 74, the layers are the same material. In other embodiments containing two or more upper 3 layers 74, the layers are different material. In some embodiments, the various upper sections 73 are all made of the same materials and have generally the same layer 74 composition. In other embodiments, the various upper sections 73 are made of different materials and have generally different layer 74 compositions. Similar to shaft 4, the varying constructions of upper 3 are important for functions where differing materials are beneficial for different areas of upper 3. For instance, having toe area 7 composed of a more protective and sturdy material than the rest of upper 3 is beneficial in hazardous occupations such as construction. As discussed above with the shaft, the embodiments where upper 3 layers 74 are different materials are useful when different properties or characteristic are desired on the outside and inside of the shoe, or when insulation is desired.

FIG. 3 shows shaft 4 whose top (47) is about fifteen inches above top 6 of the heel region (9). Depending on the embodiment the length of shaft 4 could be longer or shorter. The varying shaft 4 heights aid in flexibility and ease of getting shaft 4 on and off, with the longer shafts giving protection to a larger section of the calf, but having less flexibly in comparison to the shorter shafts. Thus, depending on the individual protective or stylistic need, varying shaft 4 lengths are required. Additionally, varying notch, aperture, and protrusion configurations would be more optimal with certain sized shafts. In one embodiment of the invention, top 47 of shaft 4 is six to eight inches from top 6 of the heel region (9). In another embodiment, top 47 of shaft 4 is eight to ten inches from top 6 of the heel region (9). In another embodiment, top 47 of shaft 4 is ten to twelve inches from top 6 of the heel region (9). In another embodiment, top 47 of shaft 4 is twelve to fifteen inches from top 6 of the heel region (9). In another embodiment, top 47 of shaft 4 is fifteen to eighteen inches from top 6 of the heel region (9). These varying embodiments are required due to individual needs. Obviously, a person who is seven feet tall is going to need a significantly longer shaft 4 to protect and cover the same calf proportion as someone who is five feet tall. Thus, embodiments with fifteen to eighteen inch shafts 4 are useful for taller individuals, or for individuals who want maximum protection. If shaft 4 is made of waterproof materials, such as rubber, shafts that extend even past the knee may be desired. On the other hand, embodiments with shaft 4 only six to eight inches tall are useful for shorter individuals or for individuals who do not require significant protection. These shorter shafts 4 could be worn during hotter months for activities which do not require significant protection and where longer shafts would be unnecessarily constricting and hot. The other embodiments with different sizes give a combination of shaft heights designed for optimizing flexibility and protection depending on the situation.

FIG. 3 shows a shoe with heel 40 which extends off of heel region 9 of sole 2, and covers about half of the area under shaft 4. Heel 40 can simply be used for a specific design, however, heel 40 is intended for functional purposes, such as a means of securing shoe 1 into a stirrup. Heel 40 height is measured at the front (72) of the heel 40 from the bottom (5) to the top (6) of sole 2. The size of heel 40 affects the functionality, as shoes with taller heels are easier to secure into stirrups but are harder to walk in, since toe region 7 needs to arch more drastically in order to be able to touch the ground. Because of this, in some embodiments heel 40 is about one to three inches high and in other embodiments heel 40 is less than one inch high. The embodiment with larger heel 40 gives greater functionality but more toe region 7 arch and thus more difficulty walking, while the smaller heel 40 embodiments gives less functionality but are easier to walk in. These differences are important as different individuals, such as the elderly, need shoes with more balance and ease of walking, and likely will not be riding as roughly on horses, thus not needing as functional of heel 40. In other embodiments heel 40 is completely removed. In some embodiments with heel 40 removed, sole 2 is flat along the bottom surface (5) as is common for sneakers, in other embodiments sole 2 still has a arch shape, and in other embodiments sole 2 has a section removed in general arch region 8.

Although the invention has been described referencing several potential embodiments, some of which are indicated by the figures presented, this was not intended to be an exhaustive list of all possible arrangements of features, materials, or the like as many other potential embodiments, modifications, or variations will be ascertainable by a person having ordinary skill in the art.

What is claimed is:

1. A shoe, comprising:

a sole;

an upper connected to said sole;

a shaft connected to said upper;

wherein said upper is comprised of an upper bottom proximal to said sole and an upper top distal from said sole;

wherein said shaft is comprised of a shaft top, a shaft bottom, a shaft right side, a shaft left side, a shaft front and a shaft back;

wherein said shaft comprises a shaft bottom aperture proximal to said upper top and a shaft top aperture distal from said upper top;

wherein said shaft includes at least one notch;

wherein said at least one notch has a notch top and a notch bottom;

wherein said at least one notch defines a notch depth which is the distance from said shaft top to said notch bottom;

wherein said shaft comprises a shaft right side aperture on said shaft right side and a shaft left side aperture on said shaft left side;

wherein said shaft right side aperture and shaft left side aperture are located in said shaft within said notch depth and wherein an area below said notch depth contains at least one vertical slice below said shaft right side aperture and at least one vertical slice below said shaft left side aperture;

wherein at least one top protrusion on said shaft right side extends from said shaft top towards said upper and has a length that is less than said notch depth;

wherein said at least one top protrusion on said shaft left side extends from said shaft top towards said upper and has a length that is less than said notch depth; and wherein a combination of said at least one notch, said at least one vertical slice below said shaft right side aperture and said at least one vertical slice below said shaft left side aperture provide enhanced flexibility of said shaft.

2. A shoe according to claim 1 wherein said at least one notch is generally perpendicular to said first and second apertures.

3. A shoe according to claim 1 wherein said at least one top protrusion on said shaft right side and said at least one top protrusion on said shaft left side are generally parallel to one another.

4. A shoe according to claim 1 wherein said upper further includes at least one aperture and at least one vertical slice.

5. A shoe according to claim 1, wherein said at least one notch is generally a V-shaped cut.

6. A shoe according to claim 1, wherein said at least one notch is five to seven inches in length.

7. A shoe according to claim 1, wherein said at least one notch is less than one inch wide.

8. A shoe according to claim 1, wherein said at least one notch is three to five inches wide.

9. A shoe according to claim 1, wherein the at least one notch comprises two or more notches.

10. A shoe according to claim 9, wherein said two or more notches have the same length and the same width.

11. A shoe according to claim 9, wherein said two or more notches have different lengths and different widths.

12. A shoe according to claim 1, wherein said upper is a single section of leather.

13. A shoe according to claim 1, wherein said upper comprises multiple upper sections.

14. A shoe according to claim 1, wherein said upper is made of a single layer.

15. A shoe according to claim 1, wherein said upper is made of multiple layers.

16. A shoe according to claim 15, wherein said multiple layers are made of the same material.

17. A shoe according to claim 15, wherein said multiple layers are made of different materials.

18. A shoe according to claim 1, wherein said sole further comprises a heel region.

19. A shoe according to claim 18, wherein said heel region comprises a heel.

20. A shoe according to claim 19, wherein said heel is one to three inches high.

* * * * *